US005677507A

United States Patent [19]

Becker et al.

[11] Patent Number: 5,677,507

[45] Date of Patent: Oct. 14, 1997

[54] REAR-LOADED MORTAR HAVING A BREECHLOCK PLUG AND A LOADING TRAY

[75] Inventors: Wilfried Becker; Hans-Ulrich Desgranges; Klaus Bornefeld, all of Celle, Germany

[73] Assignee: Rheinmetall Industrie GmbH, Ratingen, Germany

[21] Appl. No.: 702,032

[22] Filed: Aug. 23, 1996

[30] Foreign Application Priority Data

Aug. 23, 1995 [DE] Germany ..... 195 30 919.7

[51] Int. Cl.[6] ..... F41A 9/00

[52] U.S. Cl. ..... 89/47; 89/37.05

[58] Field of Search ..... 89/47, 37.05, 1.35, 89/40.02

[56] References Cited

U.S. PATENT DOCUMENTS

| | | | |
|---|---|---|---|
| 3,855,899 | 12/1974 | Billottet et al. | 89/47 |
| 4,011,797 | 3/1977 | Leshem | 89/37.05 |
| 4,198,897 | 4/1980 | Lipp et al. | 89/47 |
| 4,753,156 | 6/1988 | Winkler et al. | 89/40.02 |

FOREIGN PATENT DOCUMENTS

| | | |
|---|---|---|
| 28 37 995 | 3/1980 | Germany . |
| 2169389 | 5/1986 | United Kingdom . |
| 93/07439 | 4/1993 | WIPO . |

*Primary Examiner*—J. Woodrow Eldred
*Attorney, Agent, or Firm*—Spencer & Frank

[57] ABSTRACT

A mortar includes a weapon tube; a breech ring affixed to a rear part of the weapon tube; a loading tray supported by the weapon tube and extending rearwardly of the breech ring for receiving a mortar grenade prior to an introduction thereof into the weapon tube; and a breechblock plug movable along the loading tray for pushing a mortar grenade from the loading tray into the weapon tube. The breechblock plug has first and second positions: in the first position the breechblock plug is situated at a rear part of the loading tray and in the second position the breechblock plug is situated in the weapon tube. Further, a firing pin is provided which traverses the breechblock plug. The breechblock plug is secured in its second position by a locking mechanism.

11 Claims, 4 Drawing Sheets

REAR-LOADED MORTAR HAVING A BREECHLOCK PLUG AND A LOADING TRAY

CROSS REFERENCE TO RELATED APPLICATION

This application claims the priority of German Application No. 195 30 919.7 filed Aug. 23, 1995, which is incorporated herein by reference.

BACKGROUND OF THE INVENTION

This invention relates to a rear-loaded mortar having a breech ring, a breechblock and a firing pin passing through the breechblock.

A mortar of the above-outlined type is described, for example in published PCT Application WO 93/07439. In the structure described therein a screw-type breechblock is provided, having a breechblock plug which is axially introduced into the rear of the breech ring and is locked by turning.

The above-outlined known mortar is disadvantageous in that a screw-type breechblock whose breechblock plug is pivotally articulated to the breechblock carrier requires a substantial technical and constructional outlay for an automation of the loading process. Further, the mechanism for opening, closing and locking is relatively complicated and slow so that the attainable firing frequency is relatively small (approximately eight shots per minute). Also, the mortar grenade has to be held firmly by an additional pawl mechanism after loading the grenade in the weapon chamber, otherwise, because of the high elevation, the grenade may tend to slide out downwardly from the weapon tube before closing the breechblock.

German Offenlegungsschrift (application published without examination) No. 28 37 995 discloses a rear-loaded mortar in which the entire weapon tube has to be longitudinally shifted for permitting loading. For firing the weapon, the mortar tube is brought in front of the breechblock and locked. Such mortars require a support at the rear part of the weapon tube and are of relatively complex construction.

SUMMARY OF THE INVENTION

It is an object of the invention to provide an improved rear-loaded mortar of the above-outlined type in which a loading of mortar grenades may be carried out at high frequency at all elevations of the weapon tube and which is adapted for either manual or automatic operation.

This object and others to become apparent as the specification progresses, are accomplished by the invention, according to which, briefly stated, the mortar includes a weapon tube; a breech ring affixed to a rear part of the weapon tube; a loading tray supported by the weapon tube and extending rearwardly of the breech ring for receiving a mortar grenade prior to an introduction thereof into the weapon tube; and a breechblock plug movable along the loading tray for pushing a mortar grenade from the loading tray into the weapon tube. The breechblock plug has first and second positions: in the first position the breechblock plug is situated at a rear part of the loading tray and in the second position the breechblock plug is situated in the weapon tube. Further, a firing pin is provided which traverses the breechblock plug. The breechblock plug is secured in its second position by a locking mechanism.

Essentially, the invention is based on the principle of providing a loading element which is a part of the breechblock and obturator mechanism of the mortar. The loading element comprises an axially displaceable breechblock plug which pushes the mortar grenade from a loading tray into the weapon tube of the mortar and rearwardly seals the tube in the inserted position of the mortar grenade. The locking of the breechblock plug is effected either by a wedge-type breechblock shiftable perpendicularly to the axis of the weapon tube or by a screw-type (bayonet-type) breechblock rotatable about the axis of the weapon tube.

To ensure a satisfactory guidance of the grenades, the loading tray which is affixed to the weapon, is provided with guide ribs.

Since introducing the grenades into the loading tray may be readily automated, a mortar structured according to the invention may achieve high firing frequencies. Advantageously, the firing pin is positively guided by the shifting motion of a wedge-type breechblock or by the rotary motion of the screw-type breechblock.

It has been found to be particularly advantageous to provide the breechblock plug at its side oriented towards the weapon with an additional obturating element, made, for example, of rubber and a pressure plate arranged in front of the obturating element. By virtue of the gas pressure resulting from firing the grenade, the pressure plate is exposed to a force which firmly presses the rubber seal against that part of the weapon tube which faces the breechblock.

DESCRIPTION OF THE PREFERRED EMBODIMENTS

Figure 1:
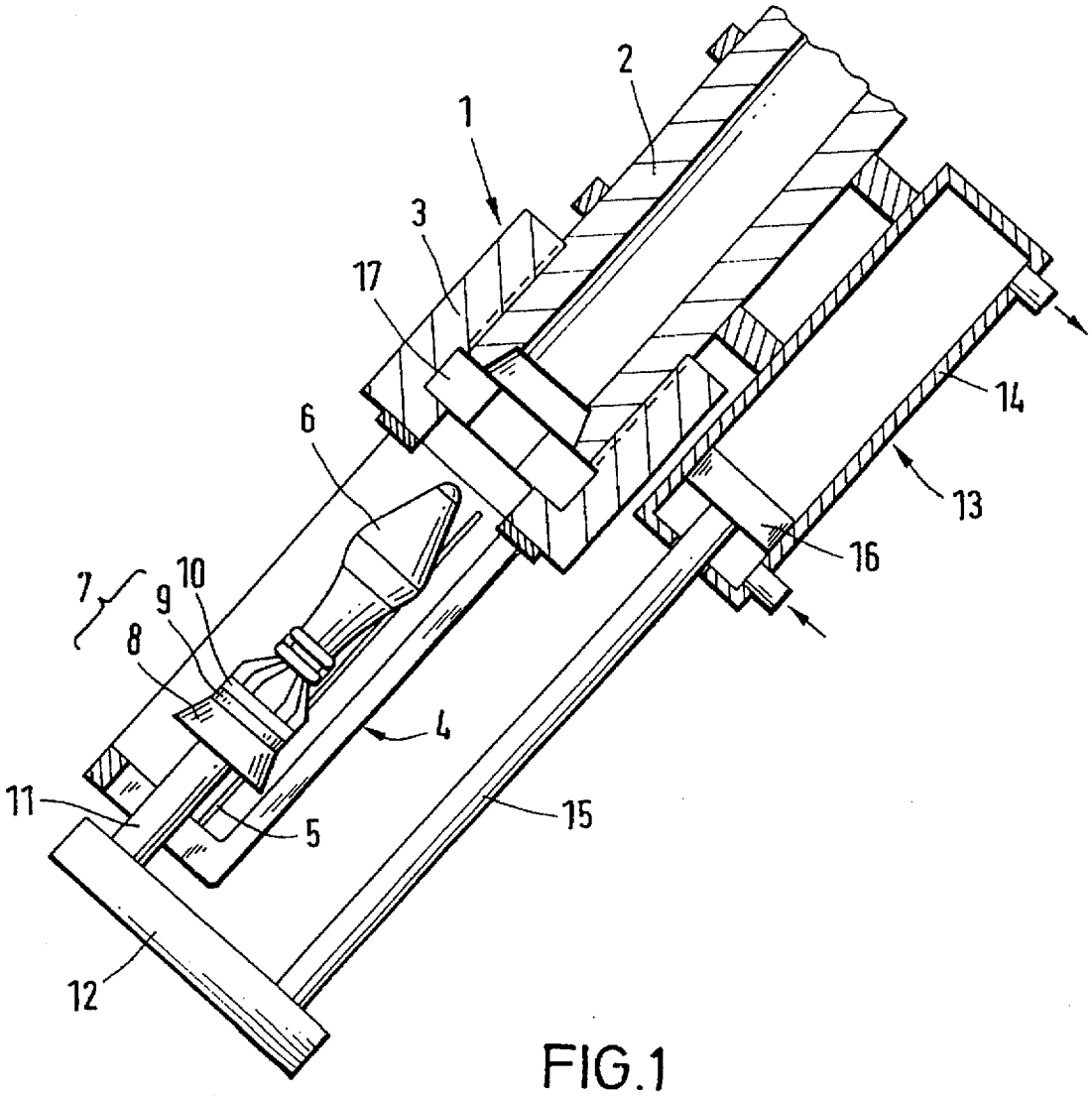
FIG. 1 is a longitudinal sectional view of the rear part of the mortar according to the invention, showing a mortar grenade on a loading tray externally of the weapon chamber.

FIG. 1 illustrates the breech region of a mortar 1, essentially composed of a weapon tube 2, a breech ring 3 and a loading tray 4 affixed to the breech ring 3.

The loading tray 4 has guide ribs 5 on which a mortar grenade 6 is supported. At its rear portion, the mortar grenade 6 is countersupported by an axially displaceable loading and obturating assembly 7 composed of a breechblock plug 8, a rubber obturating element 9 and a pressure plate 10. For shifting the loading and obturating assembly 7, the breechblock plug 8 is coupled by means of a connecting rod 11 and a carrier 12 with a pneumatic shifting device 13. The latter is composed of a pneumatic cylinder 14 in which a piston 16 is slidably received. One end of a piston rod 15 is attached to the piston 16, while the other, opposite end of the piston rod 15 is attached to the carrier 12.

Figure 2:
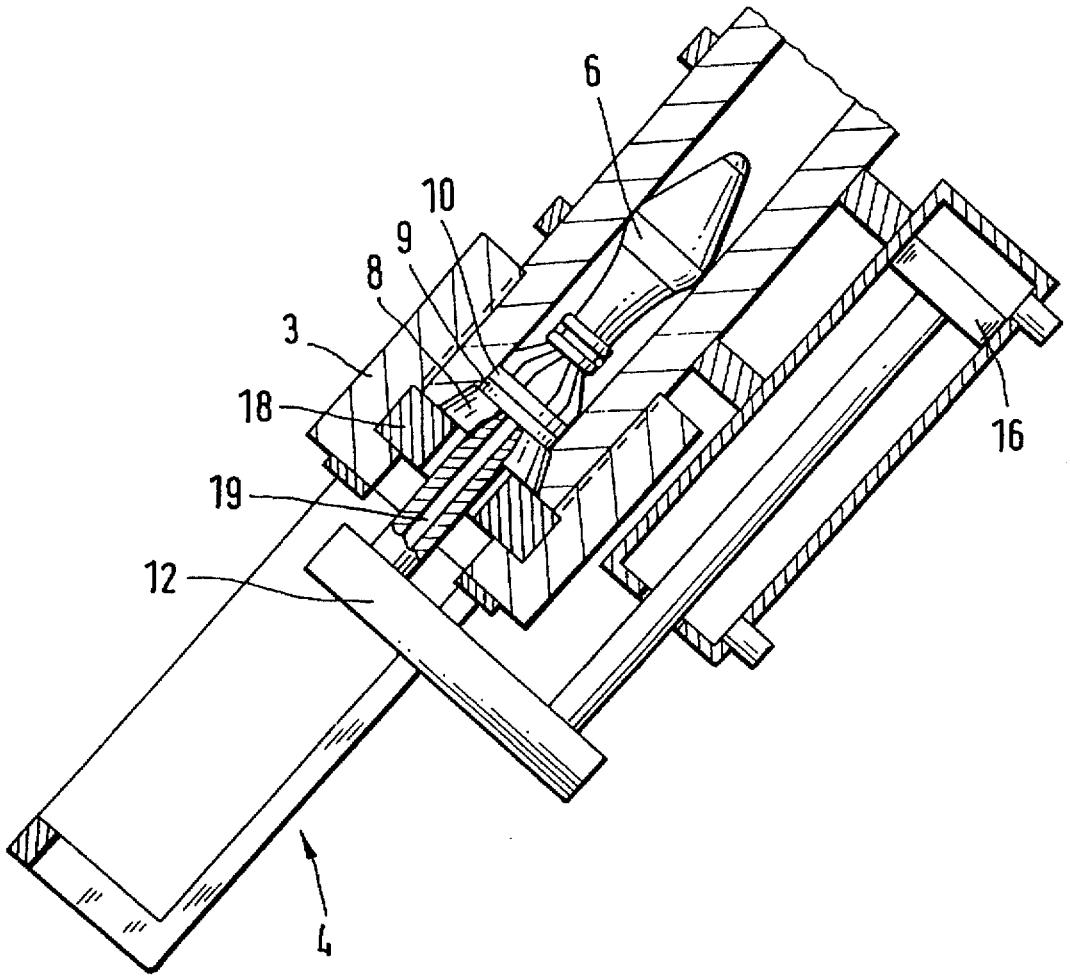
FIG. 2 is a longitudinal sectional view similar to FIG. 1, showing the mortar grenade in the weapon chamber.

With reference to FIGS. 1 and 2, in the breech ring 3 of the mortar a wedge-type breechblock 18 is provided which is received in a guide 17. The firing pin 19 required for igniting the mortar grenade passes through the hollow connecting rod 11 and the breechblock plug 8 and is coupled with a firing pin mechanism not shown for the sake of clarity.

Figure 3:
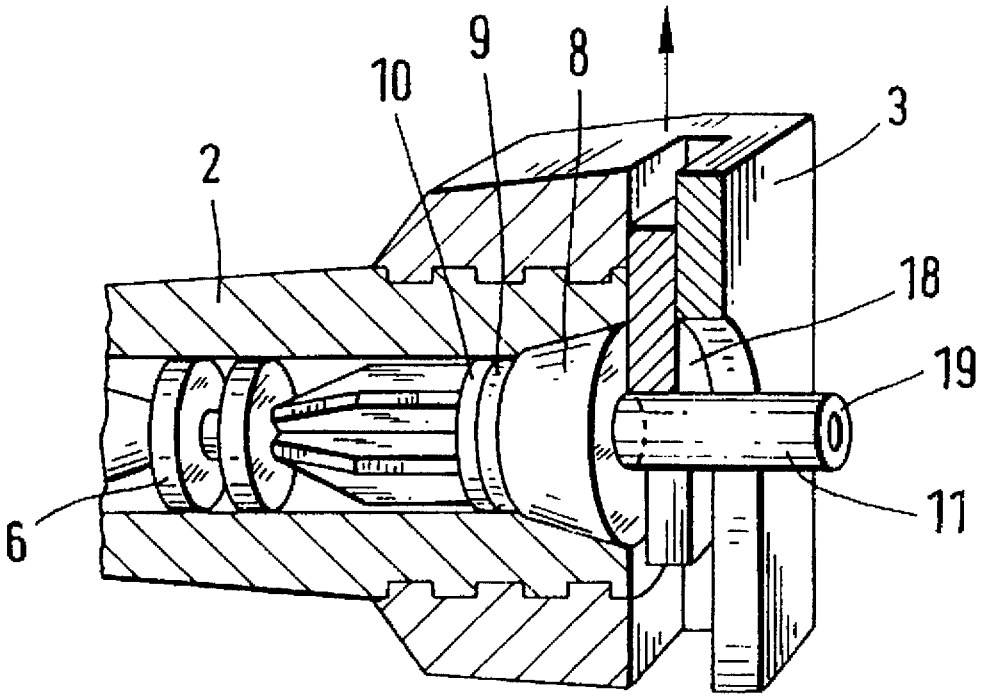
FIG. 3 is a perspective sectional view of the breech region of the mortar shown in FIG. 2.

If the pressure in the cylinder 14 is increased on that side of the piston 16 which is oriented towards the piston rod 15, the piston rod 15 pushes, via the carrier 12 and the connecting rod 11, the loading and obturating assembly 7 and thus also the mortar grenade 6 into the tube 2 of the mortar 1. After the loading process, the loading and obturating assembly 7, whose shape is complemental to the breech region of the mortar, remains in the tube. Thereafter, as shown in FIGS. 2 and 3, the wedge-type breechblock 18 is pushed in the guide 17 behind the loading and obturating assembly 7 for locking the latter. The firing pin 19 is positively guided by the motion of the wedge-type breechblock 18 and impacts on the primer of the mortar grenade 6 igniting the propellant thereof. The resulting gas pressure exerts a force on the pressure plate 10 and thus the rubber seal 9 is firmly pressed against the weapon tube 2.

It is to be understood that the invention is not limited to the described embodiment. Thus, instead of a pneumatically controllable unit, the displacing device may be a hydraulic or electric apparatus. Also, the invention may find application in an arrangement where the carrier 12 is manually shifted.

Further, dependent upon the pressure to be absorbed and the configuration of the breechblock plug, an additional obturating element and pressure plate may be dispensed with.

Figure 4:
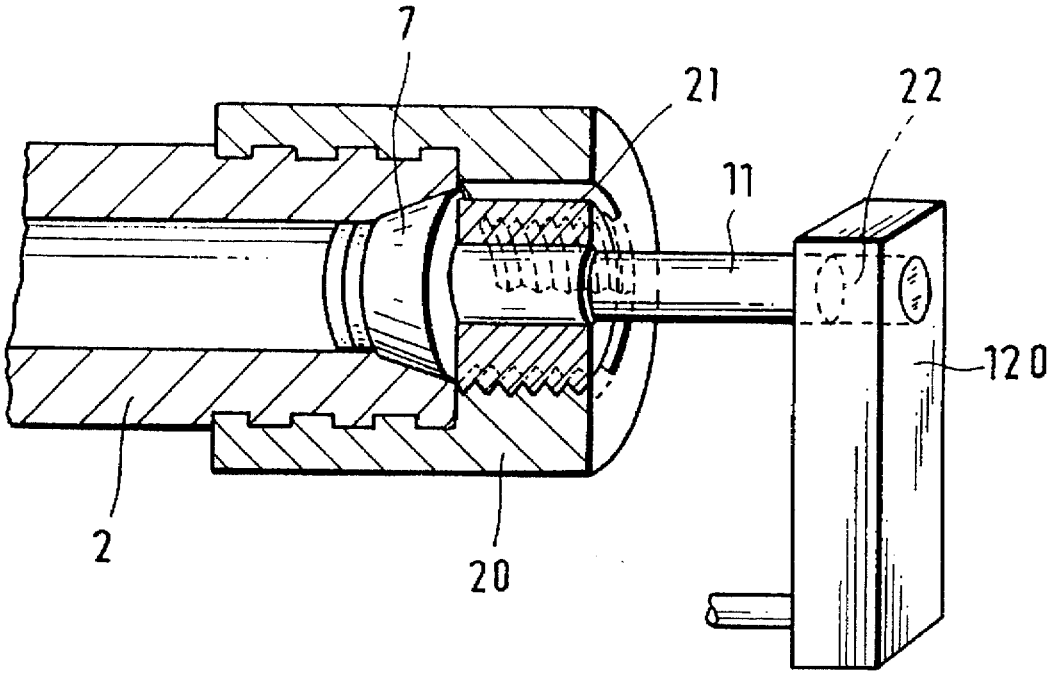
FIG. 4 is a perspective view of the breech region of a mortar according to the invention having a bayonet-type (screw-type) breechblock, showing the mortar grenade in the weapon chamber.

Also, the breechblock need not be of the wedge type; rather, the weapon may be provided with a bayonet-type (screw-type) breechblock as shown in FIG. 4. In this embodiment, at the breech end of the weapon tube 1 a breech ring 20 is provided, together with a bayonet-type breechblock 21. The carrier 120 has an integrated rotary drive 22. For locking the loading and obturating assembly 7, the latter is rotated by the drive 22 in the thread of the bayonet-type breechblock 21 and thus locked. The firing pin is positively guided by the rotation of the bayonet-type breechblock.

It will be understood that the above description of the present invention is susceptible to various modifications, changes and adaptations, and the same are intended to be comprehended within the meaning and range of equivalents of the appended claims.

What is claimed is:

1. A mortar comprising (a) a weapon tube having a rear part;

(b) a breech ring affixed to said rear part;

(c) a loading tray supported by said weapon tube and extending rearwardly of said breech ring for receiving a mortar grenade prior to an introduction thereof into the weapon tube;

(d) a breechblock plug movable along said loading tray for pushing a mortar grenade from the loading tray into said weapon tube; said breechblock plug having first and second positions; in said first position said breechblock plug being situated at a rear part of said loading tray and in said second position said breechblock plug being situated in said weapon tube;

(e) a firing pin traversing said breechblock plug; and (f) locking means for securing said breechblock plug in said second position thereof.

2. The mortar as defined in claim 1, further comprising an obturating element and a pressure plate mounted on said breechblock plug; said pressure plate facing said weapon tube and said obturating element being situated between said pressure plate and said breechblock plug, whereby in said second position of said breechblock plug propellant gases exert a rearward force on said pressure plate for pressurizing said obturating element.

3. The mortar as defined in claim 1, further comprising a guiding rib provided on said loading tray for guiding a mortar grenade thereon.

4. The mortar as defined in claim 1, further comprising power means for moving said breechblock plug between said first and second positions.

5. The mortar as defined in claim 4, wherein said power means comprises a cylinder, a piston slidably received in said cylinder, a piston rod attached to said piston, means for connecting said piston rod with said breechblock plug and means for supplying said cylinder with a pressurized fluid medium.

6. The mortar as defined in claim 4, further comprising connecting means for coupling said power means to said breechblock plug; said connecting means including a carrier attached to said power means to be movable by said power means and a connecting element coupling said carrier to said breechblock plug.

7. The mortar as defined in claim 6, wherein said connecting element is a longitudinally hollow rod; said firing pin being longitudinally received in said hollow rod.

8. The mortar as defined in claim 1, wherein said locking means comprises a wedge-type breechblock.

9. The mortar as defined in claim 8, further comprising means for positively moving said firing pin by displacements of said wedge-type breechblock.

10. The mortar as defined in claim 1, wherein said locking means comprises a screw-type breechblock.

11. The mortar as defined in claim 10, further comprising means for positively moving said firing pin by displacements of said screw-type breechblock.

* * * * *